US011104982B2

(12) United States Patent
Kwon et al.

(10) Patent No.: US 11,104,982 B2
(45) Date of Patent: Aug. 31, 2021

(54) FE-BASED NANOCRYSTALLINE ALLOY AND ELECTRONIC COMPONENT USING THE SAME

(71) Applicant: SAMSUNG ELECTRO-MECHANICS CO., LTD., Suwon-Si (KR)

(72) Inventors: Sang Kyun Kwon, Suwon-Si (KR); Han Wool Ryu, Suwon-Si (KR); Chang Ryul Jung, Suwon-Si (KR); Jong Ho Chung, Suwon-Si (KR); Jong Suk Jeong, Suwon-Si (KR); Chui Min Sim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 293 days.

(21) Appl. No.: 16/008,928

(22) Filed: Jun. 14, 2018

(65) Prior Publication Data

US 2019/0100828 A1 Apr. 4, 2019

(30) Foreign Application Priority Data

Sep. 29, 2017 (KR) ..... 10-2017-0127950

(51) Int. Cl.

| | |
|---|---|
| ***C22C 45/02*** | (2006.01) |
| ***C22C 38/12*** | (2006.01) |
| ***C22C 38/20*** | (2006.01) |
| ***C22C 38/02*** | (2006.01) |
| ***C22C 38/00*** | (2006.01) |

(Continued)

(52) U.S. Cl.

CPC ..... *C22C 45/02* (2013.01); *C22C 38/002* (2013.01); *C22C 38/02* (2013.01); *C22C 38/12* (2013.01); *C22C 38/20* (2013.01); *H01F 1/15308* (2013.01); *H01F 1/15333* (2013.01); *H01F 17/0013* (2013.01); *C21D 6/008* (2013.01); *C22C 2200/02* (2013.01); *C22C 2200/04* (2013.01); *H01F 2017/048* (2013.01)

(58) Field of Classification Search

CPC . C21D 6/008; C22C 2200/02; C22C 2200/04; C22C 45/02; H01F 1/15308; H01F 1/15333; H01F 2017/048

USPC ..... 148/304

See application file for complete search history.

(56) References Cited

U.S. PATENT DOCUMENTS 4,881,989 A * 11/1989 Yoshizawa ..... C22C 45/02 148/302
6,425,960 B1 * 7/2002 Yoshizawa ..... H01F 1/15308 148/121

(Continued)

FOREIGN PATENT DOCUMENTS

JP 5720674 B2 5/2015
KR 10-1607483 B1 3/2016

*Primary Examiner* — Jie Yang

(74) *Attorney, Agent, or Firm* — Morgan, Lewis & Bockius LLP

(57) ABSTRACT

An Fe-based nanocrystalline alloy is represented by Composition Formula, $(Fe_{(1-a)}M^1{}_a)_{100-b-c-d-e-g}M^2{}_bB_cP_dCu_eM^3{}_g$, where $M^1$ is at least one element selected from Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $0 \le a \le 0.5$, $2 \le b \le 3$, $9 \le c \le 11$, $1 \le d \le 2$, $0.6 \le e \le 1.5$, and $9 \le g \le 11$.

15 Claims, 4 Drawing Sheets

(51) Int. Cl.

| | |
|---|---|
| ***H01F 1/153*** | (2006.01) |
| ***H01F 17/00*** | (2006.01) |
| *H01F 17/04* | (2006.01) |
| *C21D 6/00* | (2006.01) |

(56) References Cited

U.S. PATENT DOCUMENTS

| | | | | |
|---|---|---|---|---|
| 8,491,731 | B2 * | 7/2013 | Makino | C22C 38/16 148/307 |
| 2009/0242825 | A1 * | 10/2009 | Ohwaki | H01F 41/0246 252/62.54 |
| 2012/0318412 | A1 | 12/2012 | Ohta et al. | |
| 2019/0055635 | A1 * | 2/2019 | Kwon | C22C 38/002 |

* cited by examiner

FE-BASED NANOCRYSTALLINE ALLOY AND ELECTRONIC COMPONENT USING THE SAME

CROSS-REFERENCE TO RELATED APPLICATION(S)

This application claims the benefit of priority to Korean Patent Application No. 10-2017-0127950 filed on Sep. 29, 2017 in the Korean Intellectual Property Office, the disclosure of which is incorporated herein by reference in its entirety.

BACKGROUND

1. Field

The present disclosure relates to an Fe-based nanocrystalline alloy and an electronic component using the same.

2. Description of Related Art

In technical fields including devices such as an inductor, a transformer, a motor magnetic core, a wireless power transmission device, and the like, research has been conducted into developing a soft magnetic material having a small size and improved high-frequency properties. Recently, research has been conducted into an Fe-based nanocrystalline alloy.

The Fe-based nanocrystalline alloy has advantages in that it has high permeability and a saturation magnetic flux density two times greater than that of existing ferrite, and it operates at a high frequency, as compared to an existing metal.

Recently, a novel nanocrystalline alloy composition for improving saturation magnetic flux density has been developed to improve the performance of the Fe-based nanocrystalline alloy. Particularly, in magnetic induction type wireless power transmission equipment, a magnetic material is used to decrease an influence of electromagnetic interference (EMI)/electromagnetic compatibility (EMC) caused by a surrounding metal material and improve wireless power transmission efficiency.

As the magnetic material, for efficiency improvement, slimming and lightening of a device, and particularly, high speed charging capability, a magnetic material having a high saturation magnetic flux density has been used. However, such a magnetic material having a high saturation magnetic flux density may have a high loss and generates heat, such that there are drawbacks to using this magnetic material.

SUMMARY

An aspect of the present disclosure may provide an Fe-based nanocrystalline alloy having a low loss while having a high saturation magnetic flux density, and an electronic component using the same. The Fe-based nanocrystalline alloy as described above has advantages in that nanocrystalline grains may be easily formed even in a form of powder, and magnetic properties such as the saturation magnetic flux density, and the like, are excellent.

An aspect of the present disclosure, an Fe-based nanocrystalline alloy may be represented by a Composition Formula, $(Fe_{(1-a)}M^1{}_a)_{100-b-c-d-e-g}M^2{}_bB_cP_dCu_eM^3{}_g$, where $M^1$ is at least one element selected from Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $0 \le a \le 0.5$, $9 \le c \le 11$, $0.6 \le e \le 1.5$, and $9 \le g \le 11$.

In a differential scanning calorimetry (DSC) graph, a primary peak may have a bimodal shape.

The Fe-based nanocrystalline alloy may be in a powder form, and the powder may be composed of particles having a size distribution with a $D_{50}$ of 20 um or more.

A parent phase of the Fe-based nanocrystalline alloy may have an amorphous single phase structure.

A saturation magnetic flux density of the Fe-based nanocrystalline alloy may be 1.4 T or more.

According to another aspect of the present disclosure, an electronic component may include: a coil part; and an encapsulant encapsulating the coil part and containing an insulator and a large number of magnetic particles dispersed in the insulator, wherein the magnetic particles contain an Fe-based nanocrystalline alloy represented by Composition Formula, $(Fe_{(1-a)}M^1{}_a)_{100-b-c-d-e-g}M^2{}_bB_cP_dCu_eM^3{}_g$, where $M^1$ is at least one element selected from Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $0 \le a \le 0.5$, $2 \le b \le 3$, $9 \le c \le 11$, $1 \le d \le 2$, $0.6 \le e \le 1.5$, and $9 \le g \le 11$.

In a differential scanning calorimetry (DSC) graph, a primary peak of the Fe-based nanocrystalline alloy may have a bimodal shape.

The magnetic particles may have a size distribution with a $D_{50}$ of 20 um or more.

A parent phase of the Fe-based nanocrystalline alloy may have an amorphous single phase structure.

A saturation magnetic flux density of the Fe-based nanocrystalline alloy may be 1.4 T or more.

According to another aspect of the present disclosure, a method of manufacturing an Fe-based nanocrystalline alloy, comprises steps of: preparing a parent phase of the Fe-based nanocrystalline alloy, and heat treating the parent phase of the Fe-based nanocrystalline alloy to obtain the Fe-based nanocrystalline alloy. The Fe-based nanocrystalline alloy is represented by Composition Formula, $(Fe_{(1-a)}M^1{}_a)_{100-b-c-d-e-g}M^2{}_bB_cP_dCu_eM^3{}_g$, where $M^1$ is at least one element selected from Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $0 \le a \le 0.5$, $2 \le b \le 3$, $9 \le c \le 11$, $1 \le d \le 2$, $0.6 \le e \le 0.5$, and $9 \le g \le 11$.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Electronic Component

Hereinafter, an electronic component according to an exemplary embodiment in the present disclosure will be described, and as a representative example, a coil component was selected. However, an Fe-based nanocrystalline alloy to be described below may also be applied to other electronic components, for example, a wireless charging device, a filter, and the like, as well as the coil component.

Figure 1:
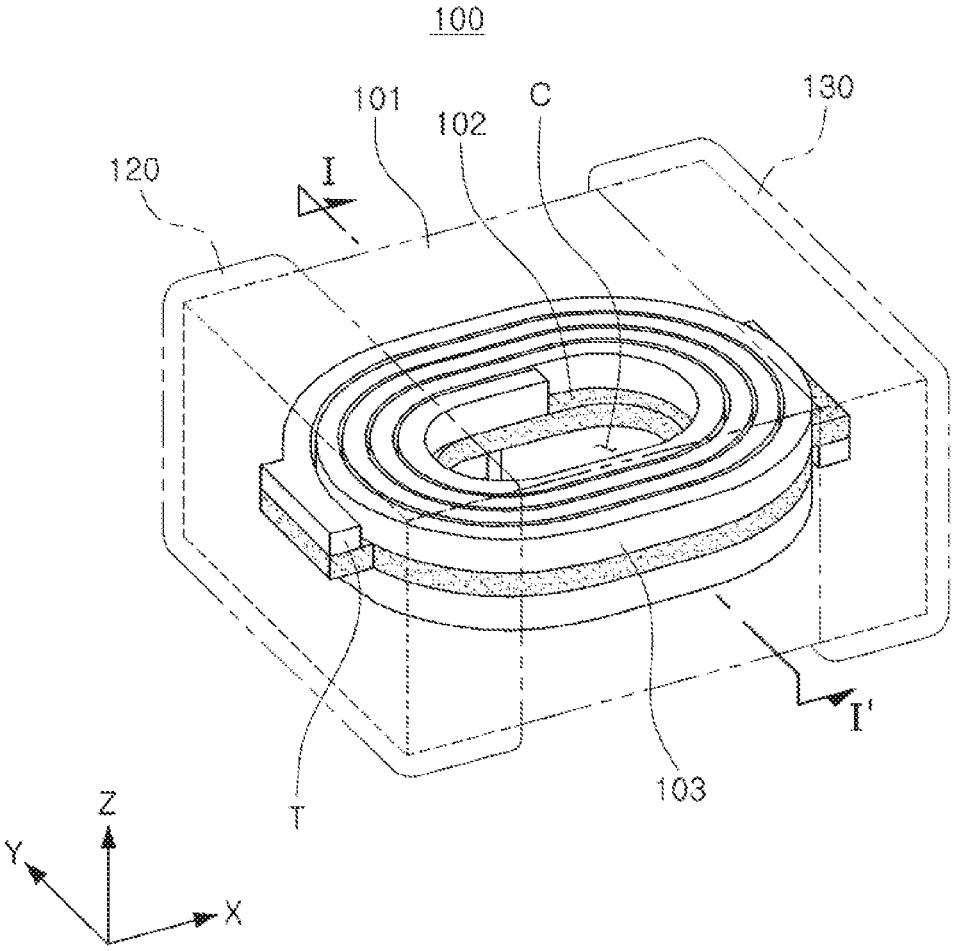
FIG. 1 is a schematic perspective view illustrating a coil component according to an exemplary embodiment in the present disclosure.
Figure 2:
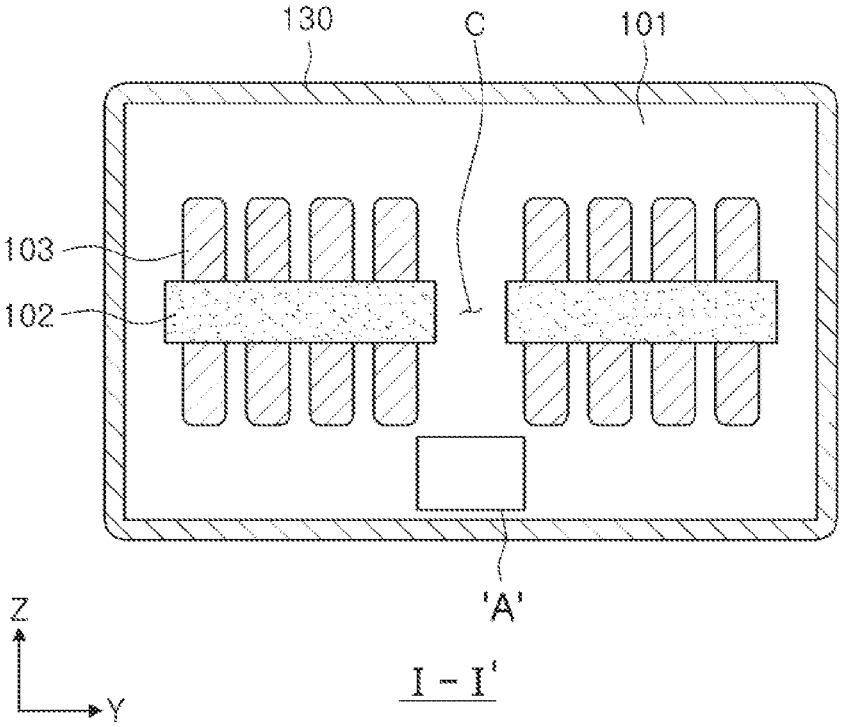
FIG. 2 is a cross-sectional view taken along line I-I' of FIG. 1.
Figure 3:
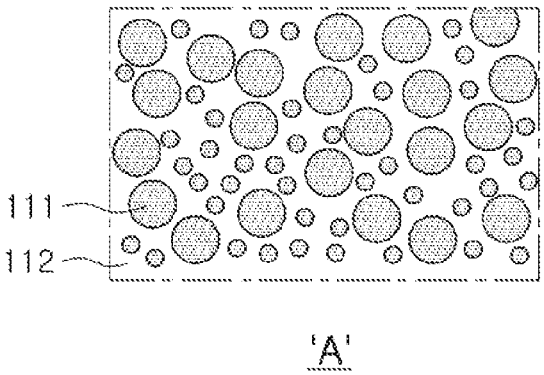
FIG. 3 is an enlarged view of a region of an encapsulant in the coil component of FIG. 2.

FIG. 1 is a perspective view schematically illustrating an exterior of a coil component according to an exemplary embodiment in the present disclosure. Further, FIG. 2 is a cross-sectional view taken along line I-I' of FIG. 1. FIG. 3 is an enlarged view of a region of an encapsulant in the coil component of FIG. 2.

Referring to FIGS. 1 and 2, a coil component 100 according to the exemplary embodiment in the present disclosure may have a structure including a coil part 103, an encapsulant 101, and external electrodes 120 and 130.

The encapsulant 101 may encapsulate the coil part 103 to protect the coil part 103, and may contain a large number of magnetic particles 111 as illustrated in FIG. 3. More specifically, the magnetic particles 111 may be in a state in which the magnetic particles 111 are dispersed in an insulator 112 formed of a resin, or the like. In this case, the magnetic particles 111 may contain a Fe-based nanocrystalline alloy. For example, the magnetic particles 111 may be formed of an Fe—Si—B—Nb—Cu-based alloy, and a composition of the Fe-based nanocrystalline alloy will be described below. When the Fe-based nanocrystalline alloy having the composition suggested in the present exemplary embodiment is used, even in a case of preparing the Fe-based nanocrystalline alloy in a form of powder, a size, a phase, and the like, of a nanocrystalline grain may be suitably controlled, such that the nanocrystalline grain exhibits magnetic properties suitable for being used in an inductor.

The coil part 103 may perform various functions in an electronic device through properties exhibited in a coil of the coil component 100. For example, the coil component 100 may be a power inductor. In this case, the coil part 103 may serve to store electricity in a form of a magnetic field form to maintain an output voltage, thereby stabilizing power, or the like. In this case, coil patterns constituting the coil part 103 may be stacked on both surfaces of a support member 102, respectively, and electrically connected to each other by a conductive via penetrating through the support member 102. The coil part 103 may be formed in a spiral shape, and include lead portions T formed in outermost portions of the spiral shape to be exposed to the outside of the encapsulant 101 for electrical connection with the external electrodes 120 and 130. The coil pattern constituting the coil part 103 may be formed using a plating method used in the art, for example, a pattern plating method, an anisotropic plating method, an isotropic plating method, or the like. The coil pattern may be formed to have a multilayer structure using two or more of the above-mentioned methods.

The support member 102 supporting the coil part 103 may be formed of, for example, a polypropylene glycol (PPG) substrate, a ferrite substrate, a metal-based soft magnetic substrate, or the like. In this case, a through hole may be formed in a central region of the support member 102, and filled with a magnetic material to form a core region C. This core region C may constitute a portion of the encapsulant 101. As described above, as the core region C may be formed to be filled with the magnetic material, performance of the coil component 100 may be improved.

The external electrodes 120 and 130 may be formed on the encapsulant 101 to be connected to the lead portions T, respectively. The external electrodes 120 and 130 may be formed using a conductive paste containing a metal having excellent electric conductivity, wherein the conductive paste may be a conductive paste containing, for example, one of nickel (Ni), copper (Cu), tin (Sn), and silver (Ag), alloys thereof, or the like. Further, plating layers (not illustrated) may be further formed on the external electrodes 120 and 130. In this case, the plating layer may contain any one or more selected from the group consisting of nickel (Ni), copper (Cu), and tin (Sn). For example, nickel (Ni) layers and tin (Sn) layers may be sequentially formed.

As described above, according to the present exemplary embodiment, at the time of preparing the magnetic particles 111 in a form of powder, the magnetic particle 111 may contain the Fe-based nanocrystalline alloy having excellent magnetic properties. Hereinafter, features of the alloy will be described in detail.

Fe-Based Nanocrystalline Alloy

According to the research of the present inventors, it may be confirmed that at the time of preparing an Fe-based nanocrystalline alloy having a specific composition in a form of a particle having a relatively large diameter or a metal ribbon having a thick thickness, an amorphous property of a parent phase is high. Further, it may be confirmed that an ingredient having a large influence on the amorphous property of the Fe-based nanocrystalline alloy is a P ingredient. Here, the particle having a relatively large diameter may be defined as a particle having a $D_{50}$ of about 20 um or more. For example, the magnetic particles 111 may have a $D_{50}$ within a range from about 20 to 40 um. Further, when the Fe-based nanocrystalline alloy is prepared in the form of the metal ribbon, the metal ribbon may have a thickness of about 20 um or more. However, the standards for the diameter or thickness are not absolute, but may be changed depending on situations.

In a case of heat-treating the alloy having a high amorphous property, a size of a nanocrystalline grain may be effectively controlled. More specifically, the Fe-based nanocrystalline alloy suggested in the present disclosure may be represented by Composition Formula, $(Fe_{(1-a)}M^1{}_a)_{100-b-c-d-e-g}M^2{}_bB_cP_dCu_eM^3{}_g$, where $M^1$ is at least one element selected from Co and Ni, $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and a b, c, d, e, and g (based on at %) satisfy the following content conditions: $0 \le a \le 0.5$, $2 \le b \le 3$, $9 \le c \le 11$, $1 \le d \le 2$, $0.6 \le e \le 1.5$, and $9 \le g \le 11$, respectively. In addition, as a result of performing thermal analysis on the Fe-based nanocrystalline alloy as described above, a bimodal property with two primary peaks was exhibited. In other words, a primary peak of the Fe-based nanocrystalline alloy may have a bimodal shape in a differential scanning calorimetry (DSC) graph.

The following Table illustrates results obtained by performing thermal analysis and results obtained by analyzing crystallinity of parent phases while changing compositions according to Inventive Examples and Comparative Examples. An alloy having each of the compositions was prepared in a form of powder, and particle size distribution of the powder was adjusted so that $D_{50}$ thereof was within a range from 20 to 40 um. More specifically, in the present experiment, the powders were classified by size, and powders having a size of about 53 um or less were used so that the $D_{50}$ was about 30 um.

Figure 4:
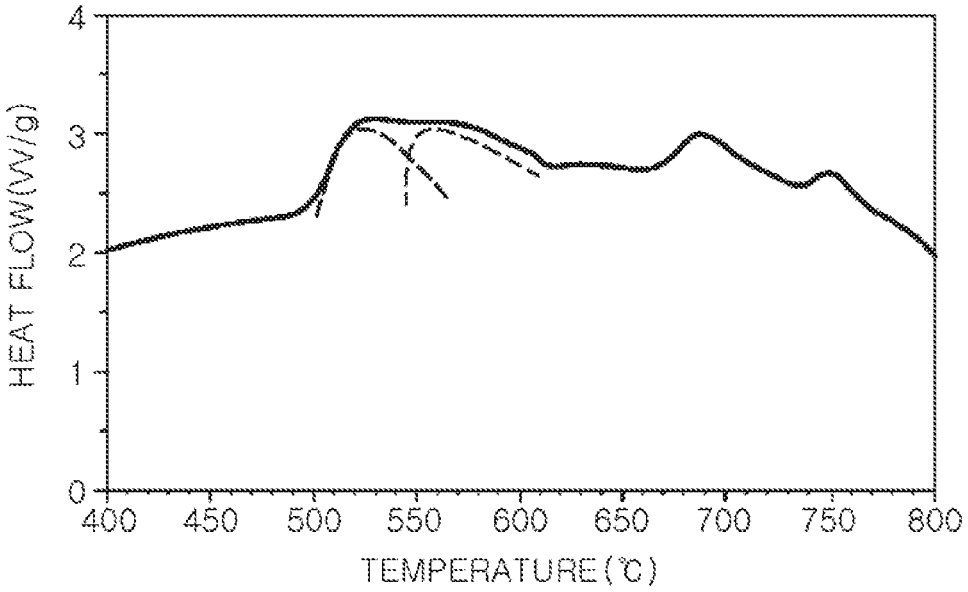
FIG. 4 is a differential scanning calorimetry (DSC) graph of an alloy according to Inventive Example.
Figure 5:
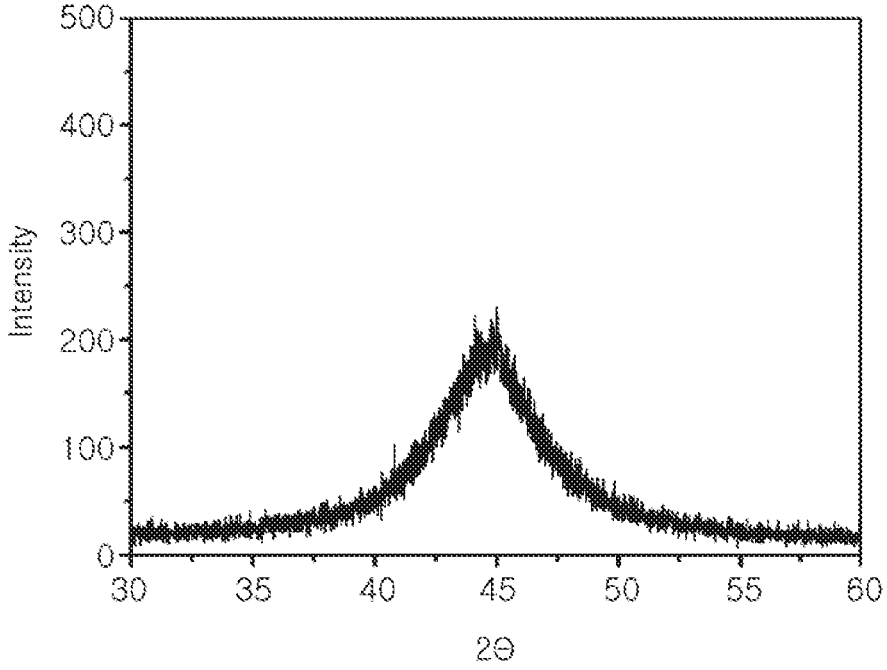
FIGS. 5 and 6 illustrate X-ray diffraction (XRD) patterns obtained by analyzing crystallinity parent phases of alloys according to Inventive Example and Comparative Example, respectively.
Figure 6:
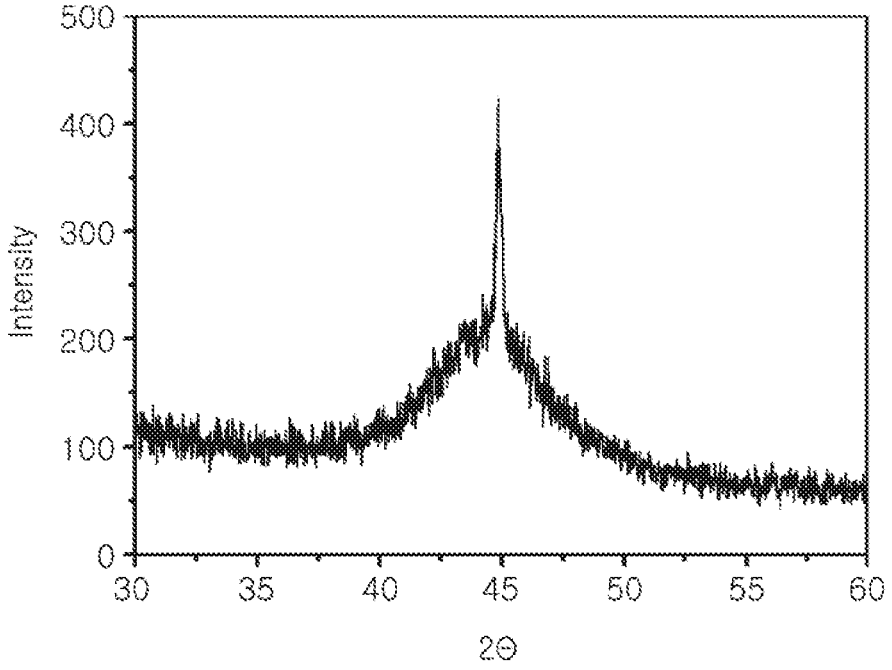

In relation to the following Table 1, FIG. 4 illustrates a DSC graph according to Inventive Example. Further, FIGS. 5 and 6 illustrate X-ray diffraction (XRD) patterns obtained by analyzing crystallinity of parent phases of alloys according to Inventive Example and Comparative Example, respectively.

TABLE 1

| | Composition (at %) | | | | | | Shape of Primary | |
|---|---|---|---|---|---|---|---|---|
| | Fe | Si | B | Nb | Cu | P | Peak | Parent Phase |
| Comparative Example 1 | 77 | 11 | 9.5 | 2 | 0.5 | 0 | Bimodal | Amorphous + Crystalline |
| Comparative Example 2 | 77 | 11 | 8 | 3 | 1 | 0 | Bimodal | Amorphous + Crystalline |
| Inventive Example 1 | 76 | 11 | 9.5 | 2 | 0.5 | 1 | Bimodal | Amorphous |
| Inventive Example 2 | 76 | 9 | 11 | 2 | 1 | 1 | Bimodal | Amorphous |
| Inventive Example 3 | 77 | 9 | 11 | 1 | 1 | 2 | Bimodal | Amorphous |

Describing the results summarized in Table 1, in all the Comparative Examples and Inventive Examples, at the time of performing thermal analysis, a bimodal crystallization peak was observed, and the parent phase has an amorphous property. Particularly, in the alloy compositions according to Inventive Examples, it was confirmed that the parent phase was only amorphous, a crystalline grain was not observed, and this amorphous property was changed depending on a content of P. According to the experiments by the present inventors, when the content of P in the alloy composition was adjusted to about 1 to 2 at % within the above-mentioned composition range, the amorphous property of the parent phase was excellent, and a nanocrystalline grain having a fine structure may be obtained by heat-treating the alloy composition.

Nanocrystalline grains were precipitated by heat-treating alloy powders obtained in the experiments, and the following Table illustrates results obtained by measuring properties (sizes of the crystalline grains, permeability, loss, and a flux density (Bs)) after heat-treatment. Heat treatment was performed at about 550° C. for 1 hour under an inert atmosphere. Further, in an experiment for magnetic properties, each of the heat-treated alloy powders (about 80%) and Fe powders (about 20%) having a size of about 1 um were mixed together with a binder (about 2 to 3%) and formed, thereby preparing test samples.

TABLE 2

| | Size of Crystalline grain (nm) | Permeability | Loss ($kW/m^3$) | Bs |
|---|---|---|---|---|
| Comparative Example 1 | 25 | 42 | 714 | 1.4 |
| Comparative Example 2 | 23 | 41 | 724 | 1.4 |
| Inventive Example 1 | 20 | 42 | 380 | 1.4 |
| Inventive Example 2 | 18 | 41 | 450 | 1.4 |
| Inventive Example 3 | 19 | 42 | 390 | 1.4 |

Referring to the results in Table 2, in Comparative Examples 1 and 2, as a content of Fe was increased, a high level of Bs was obtained, but the loss was 600 $KW/m^3$ or more, such that at the time of manufacturing a coil component using the test sample, efficiency was decreased. By comparison, since in Inventive Examples, the loss was about 500 $KW/m^3$ or less, a high level of Bs and a low level of loss may be simultaneously implemented. The reason may be that in a case in which P was added in a content of 1 to 2 at % as in Inventive Examples, since the parent phase was prepared as an amorphous phase and thus, a fine structure was uniformly obtained at the time of heat-treatment, and in Comparative Examples, at the time of heat-treatment, sizes of nanocrystalline grains were not uniform due to a crystalline phase partially existing in the parent phase.

As described above, it may be confirmed from the results illustrated in Tables 1 and 2 that in the case of the Fe-based nanocrystalline alloy in which a specific content of P was added, even in a form of the powder having a size of 20 um or more, permeability, Bs (about 1.4 T or more), and core loss properties were excellent. Hereinafter, among the elements constituting the Fe-based nanocrystalline alloy, main elements except for Fe will be described.

Boron (B) is amain element for forming and stabilizing an amorphous phase. Since B increases a temperature at which Fe, or the like, is crystallized into nanocrystals, and energy required to form an alloy of B and Fe, or the like, which determines magnetic properties, is high, B is not alloyed while the nanocrystals are formed. Therefore, there is a need to add B to the Fe-based nanocrystalline alloy. However, when a content of B is excessively high, nanocrystallization may be difficult, and a flux density (Bs) may be decreased.

Silicon (Si) may perform functions similar to those of B, and be a main element for forming and stabilizing the amorphous phase. However, unlike B, Si may be alloyed with a ferromagnetic material such as Fe to decrease a magnetic loss even at a temperature at which the nanocrystals are formed, but heat generated at the time of nanocrystallization may be increased. Particularly, in results of the research of the present inventors, it was confirmed that in a composition in which a content of Fe was high, it was difficult to control a size of a nanocrystal.

Niobium (Nb), an element controlling a size of nanocrystalline grains, may serve to limit crystalline grains formed of Fe, or the like, at a nano size, so as not to grow through diffusion. Generally, an optimal content of Nb may be 3 at %, but in experiments performed by the present inventors, due to an increase in the content of Fe, it was attempted to form a nanocrystalline alloy in a state in which the content of Nb was lower than an existing content of Nb. As a result, it was confirmed that even in a state in which the content of Nb was lower than 3 at %, the nanocrystalline grain was formed. Particularly, unlike general description that as the content of Fe is increased, the content of Nb needs to be also increased, it was confirmed that in the composition range in which the content of Fe was high and crystallization energy of the nanocrystalline grain was formed in a bimodal shape, when the content of Nb was lower than the existing content of Nb, magnetic properties were rather improved. It was confirmed that in a case in which the content of Nb was high, permeability corresponding to magnetic properties was rather decreased, and a loss was rather increased.

Phosphorus (P), an element improving an amorphous property in amorphous and nanocrystalline alloys, has been known as a metalloid together with existing Si and B. However, since binding energy with Fe corresponding to a ferromagnetic element is high as compared to B, when an Fe+P compound is formed, deterioration of magnetic properties is increased. Therefore, P was not commonly used, but recently, in accordance of the development of a composition having a high Bs, P has been studied in order to secure a high amorphous property.

Meanwhile, copper (Cu) may serve as a seed lowering nucleation energy for forming nanocrystalline grains. In this case, there was no significant difference with a case of forming an existing nanocrystalline grain.

As set forth above, according to exemplary embodiments in the present disclosure, the Fe-based nanocrystalline alloy having a low loss while having a high saturation magnetic flux density, and the electronic component using the same may be implemented. The Fe-based nanocrystalline alloy as described above have advantages in that nanocrystalline grain may be easily formed even in a form of powder, and magnetic properties such as the saturation magnetic flux density, and the like, are excellent.

While exemplary embodiments have been shown and described above, it will be apparent to those skilled in the art that modifications and variations could be made without departing from the scope of the present invention as defined by the appended claims.

What is claimed is:

1. An Fe-based nanocrystalline alloy represented by composition formula (at %), $Fe_{100-b-c-d-e-g}M^2{}_bB_cP_dCu_eM^3{}_g$, where $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $2 \le b \le 3$, $9 \le c \le 11$, $1 \le d \le 2$, $0.6 \le e \le 1.5$, and $9 \le g \le 11$, wherein the Fe-based nanocrystalline alloy is in a powder form, and the powder is composed of particles having a size distribution with a D50 of 20 um or more.

2. The Fe-based nanocrystalline alloy of claim 1, wherein in a differential scanning calorimetry (DSC) graph, a primary peak has a bimodal shape.

3. The Fe-based nanocrystalline alloy of claim 1, wherein a parent phase of the Fe-based nanocrystalline alloy has an amorphous single phase structure.

4. The Fe-based nanocrystalline alloy of claim 1, wherein a saturation magnetic flux density of the Fe-based nanocrystalline alloy is 1.4 T or more.

5. The Fe-based nanocrystalline alloy of claim 1, wherein an amount of the Fe is at least 76 at %.

6. An electronic component comprising:

a coil part; and an encapsulant encapsulating the coil part and containing an insulator and magnetic particles dispersed in the insulator, wherein the magnetic particles contain an Fe-based nanocrystalline alloy represented by composition formula (at %), $Fe_{100-b-c-d-e-g}M^2{}_bB_cP_dCu_eM^3{}_g$, where $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $2 \le b \le 3$, $9 \le c \le 11$, $1 \le d \le 2$, $0.6 \le e \le 1.5$, and $9 \le g \le 11$, wherein the Fe-based nanocrystalline alloy is in a powder form, and the powder is composed of particles having a size distribution with a D50 of 20 um or more.

7. The electronic component of claim 6, wherein in a differential scanning calorimetry (DSC) graph, a primary peak of the Fe-based nanocrystalline alloy has a bimodal shape.

8. The electronic component of claim 6, wherein a parent phase of the Fe-based nanocrystalline alloy has an amorphous single phase structure.

9. The electronic component of claim 6, wherein a saturation magnetic flux density of the Fe-based nanocrystalline alloy is 1.4 T or more.

10. The electronic component of claim 6, wherein an amount of the Fe is at least 76 at %.

11. A method of manufacturing an Fe-based nanocrystalline alloy, comprising steps of:

preparing a parent phase of the Fe-based nanocrystalline alloy, and heat treating the parent phase of the Fe-based nanocrystalline alloy to obtain the Fe-based nanocrystalline alloy, wherein the Fe-based nanocrystalline alloy is represented by composition formula (at %), $Fe_{100-b-c-d-e-g}M^2{}_bB_cP_dCu_eM^3{}_g$, where $M^2$ is at least one element selected from the group consisting of Nb, Mo, Zr, Ta, W, Hf, Ti, V, Cr, and Mn, $M^3$ is at least one element selected from the group consisting of C, Si, Al, Ga, and Ge, and $2 \le b \le 3$, $9 \le c \le 11$, $1 \le d \le 2$, $0.6 \le e \le 1.5$, and $9 \le g \le 11$, wherein the Fe-based nanocrystalline alloy is in a powder form, and the powder is composed of particles having a size distribution with a D50 of 20 um or more.

12. The method of claim 11, wherein in a differential scanning calorimetry (DSC) graph, a primary peak of the Fe-based nanocrystalline alloy has a bimodal shape.

13. The method of claim 11, wherein the parent phase of the Fe-based nanocrystalline alloy has an amorphous single phase structure.

14. The method of claim 11, wherein a saturation magnetic flux density of the Fe-based nanocrystalline alloy is 1.4 T or more.

15. The method of claim 11, wherein an amount of the Fe is at least 76 at %.

* * * * *